US005152595A

United States Patent [19]

Zaccone

[11] Patent Number: 5,152,595

[45] Date of Patent: Oct. 6, 1992

[54] SHELVING SYSTEM AND METHOD OF INSTALLATION

[76] Inventor: Samuel G. Zaccone, 1315 N. 13th Ave., Melrose Park, Ill. 60160

[21] Appl. No.: 681,476

[22] Filed: Apr. 3, 1991

Related U.S. Application Data

[63] Continuation-in-part of Ser. No. 529,589, May 29, 1990, abandoned.

[51] Int. Cl.[5] ..... A47B 47/00

[52] U.S. Cl. ..... 312/257.1; 108/64

[58] Field of Search ..... 108/64, 102, 143, 42; 312/229, 257.1

[56] References Cited

U.S. PATENT DOCUMENTS 1,504,522 8/1924 Sherer ..... 108/102
1,684,589 9/1928 Kirts ..... 312/348.3
1,966,928 7/1934 Friedel ..... 108/64
2,266,274 12/1941 Schroeder ..... 108/42 X
4,500,146 2/1985 Peterson ..... 108/102

*Primary Examiner*—Joseph Falk
*Attorney, Agent, or Firm*—Edmond T. Patnaude

[57] ABSTRACT

There is disclosed a system for the installation of one or more shelves in a cabinet. Included in the system are a pair of shelf guide rail assemblies which are adapted to be respectively mounted to the side walls of a cabinet for slidably receiving the shelves. The shelves are each of two-piece construction and adjustable in length. The shelves may be provided with a rearwardly disposed slot for receiving the plumbing when the system is installed in a cabinet into which a sink has been installed. A number of precut filler pieces are provided for the filling the spaces between the top surfaces of the respective sections of the shelves.

13 Claims, 4 Drawing Sheets

SHELVING SYSTEM AND METHOD OF INSTALLATION

Application is a continuation-in-part of application Ser. No. 07/529,589 filed May 29, 1990, now abandoned. The present invention generally relates to sliding shelves, and it relates more particularly to a new and improved shelving system and a method of installing shelves in a cabinet.

BACKGROUND OF THE INVENTION

Many cabinets such as bathroom vanities are commonly installed without any shelves thus resulting in considerable wasted storage space. Persons with good carpentry skills can, of course, construct custom shelving for such cabinets, but that is a difficult task for many persons who would prefer to install such shelves themselves. For reasons of economy it would be desirable to provide a simple system to enable relatively unskilled persons to readily install shelves in cabinets. Because the widths of such cabinets vary over a considerable range, it would be desirable for the system to be usable with most if not all of the cabinet widths normally encountered. Because some cabinets such as vanity cabinets incorporate centrally located water drain connections which depend from an associated sink, it is desirable that the shelving be adapted to maximize the storage area within a cabinet with or without plumbing.

SUMMARY OF THE INVENTION

Briefly, there is provided in accordance with the present invention a new and improved shelving system which includes a plurality of longitudinally adjustable shelves each including a matching pair of overlapping shelf pieces, a pair of guide rail mount assemblies for attachment to the interior side walls of a cabinet, fasteners for securing the guide mount assemblies to the cabinet, and plurality of precut adjustable filler pieces for filling spaces of adjustable width on the tops

GENERAL DESCRIPTION OF THE DRAWINGS of the shelves.

Further objects and advantages and a better understanding of the present invention will be had by reference to the following detailed description taken in connection with the accompanying drawings wherein.

DETAILED DESCRIPTION OF TWO PREFERRED EMBODIMENTS OF THE INVENTION

Figure 1:
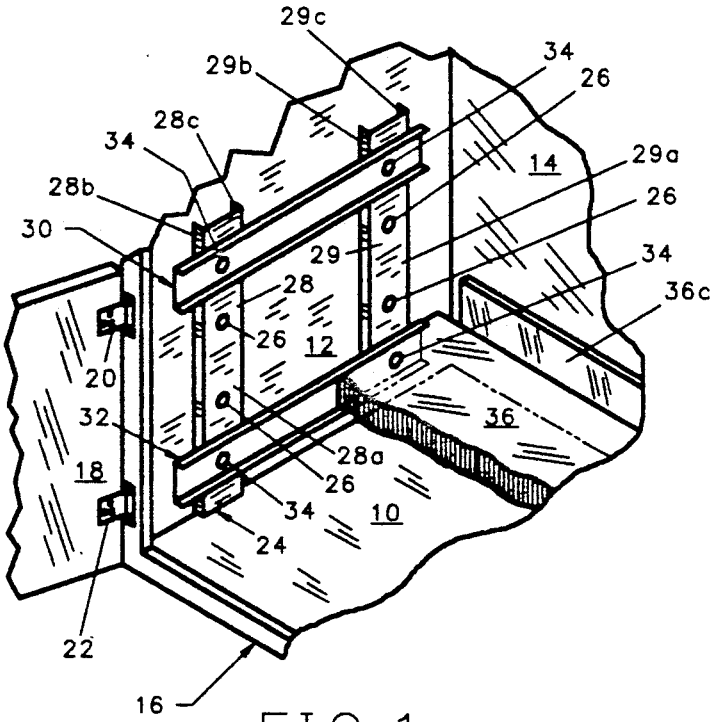
FIG. 1 is an isometric view of a bathroom vanity type cabinet in which the shelving system of the present invention has been partially installed.

Referring particularly to FIG. 1 there is shown the lower left-hand corner portion of a bathroom vanity cabinet. The cabinet includes a floor 10, two side walls 12, a rear wall 14, a front frame 16, and a door 18 hingedly mounted to the vertical part of the frame by means of a pair of hinges 20 and 22. As thus far described the cabinet is of a well known construction and is intended to be representative of the cabinets now in use, and specifically incorporating the plumbing of a bathroom vanity.

Figure 2:
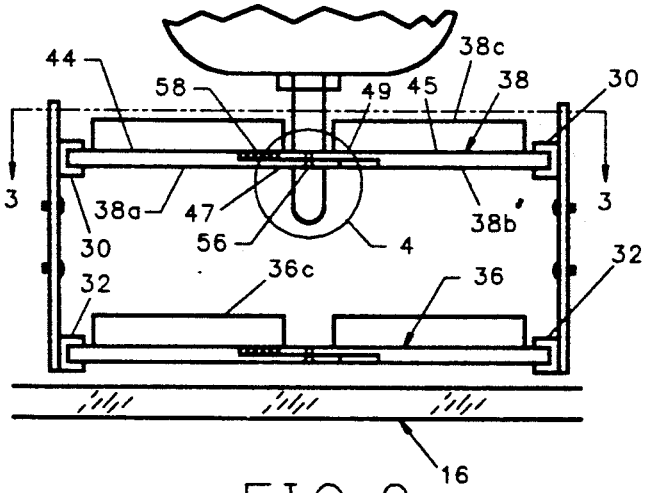
FIG. 2 is a front elevational view of the vanity cabinet of FIG. 1 with the entire shelving system of the present invention installed therein.
Figure 3:
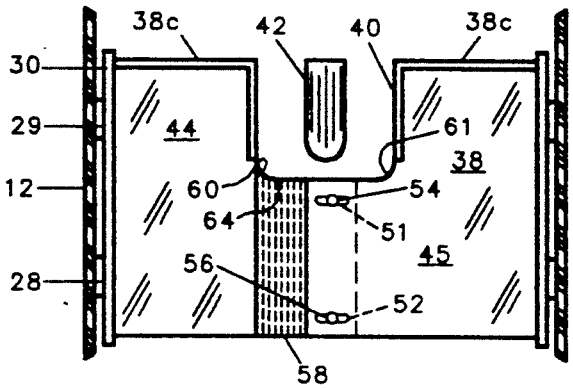
FIG. 3 is a sectional view taken along the line 3—3 of FIG. 2 and including a plan view of the top shelf and associated guide rails and mounting assembly.
Figure 4:
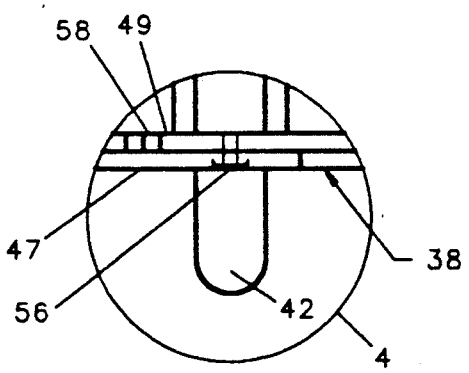
FIG. 4 is a greatly enlarged view of the portion of the top shelf as shown 4 in FIG. 2.

In accordance with the present invention a shelf guide mount assembly 24 is fixedly mounted to the interior face of the side wall 12 by means of a plurality of fastening devices 26. The fastening devices may be of any suitable type including wood screws when the wall member 12 is wood. The assembly includes a pair of vertically disposed support member 28 and 29 which are preferably metal channel pieces having central web sections 28*a* and 29*a* and side flanges 28*b* and 28*c* and 29*b* and 29*c*. The web portions 28*a* and 29*b* are provided with predrilled openings for receiving the fasteners 26. Upper and lower guide rails 30 and 32 which are mutually parallel and extend in horizontal directions are permanently affixed to the upright supports 28 and 29 by any suitable means such as spot weldments 34. The guide rails 30 and 32 are identical and are constituted by open ended C-channels having upper and lower inwardly extending flanges between which are located the end portions of the associated shelves In FIG. 1 only the lower shelf 36 is shown. The lower shelf 36 is slidable along the rail 32 in the horizontal plane and the upper shelf 38 slidable along the top rail 30 as shown in FIGS. 2 and 3. It is important that the outer ends of the shelves 36 and 38 clear the frame 16 of the cabinet, and if necessary the vertical support member 28 and 29 may be spaced from the wall 12 by suitable shims (not shown).

As may best be seen in FIG. 2 the upper and lower shelves are of the same basic two-piece construction, but as described in detail hereinafter and best shown in FIG. 3 the upper shelf is provided with a cutout 40 for receiving the plumbing 42 associated with the cabinet. No such cutout is provided in the shelf 36. Both shelves have upstanding rear walls 36*c* and 38*c* respectively for preventing articles resting on the shelves from falling off when the shelves are moved.

The upper shelf 38 may be seen to comprise first and second shelf members or boards 38*a* and 38*b* having overlapping centrally disposed central sections and respective upper surfaces 44 and 45 which lie in a common horizontal plane. Considered in greater detail, the shelf parts 38*a* and 38*b* are respectively provided with longitudinally extending tongue portions 47 and 49. A pair of spaced apart longitudinally extending slots 51 and 52 are provided in the tongue section 47 for receiving respective ones of a pair of nut and bolt assemblies 54 and 56 which lock the shelf parts 38*a* and 38*b* together in the longitudinally adjusted positions. Preferably a pair of T-nuts are recessed in the tongue 49 for receiving the bolt portion of the assemblies 54 and 56 and therefore the top surface 45 is essentially flat.

It will be apparent that a space is provided on the top of the tongue 47 at the distal end of the tongue 49, and such space has a width which differs depending on the width of the cabinet in which the shelving system is installed. This space is occupied by a filler piece 58 as shown best in FIGS. 2 and 3. The filler piece 58 has a thickness which is equal to that of the tongue 49 so that when positioned over the exposed portion of tongue 47 at the end of the tongue 49 the upper surface of the filler piece 58 is flush with the surfaces 44 and 45 of the shelf parts 38*a* and 38*b*.

Figure 5:
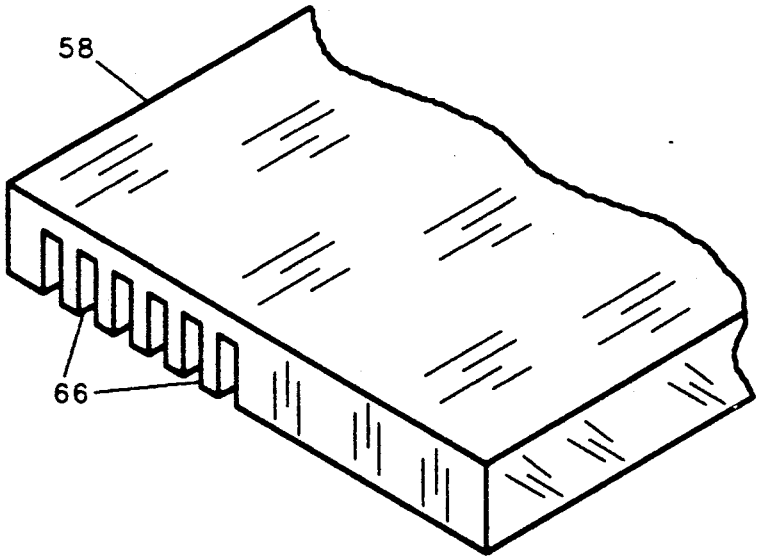
FIG. 5 is a fragmentary isometric view of an adjustable filler piece used in the shelves shown in FIG. 3.
Figure 6:
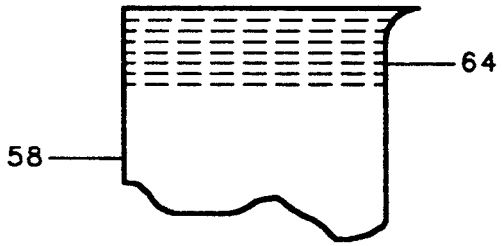
FIG. 6 is a plan view of the filler piece shown in FIG. 5.
Figure 7:
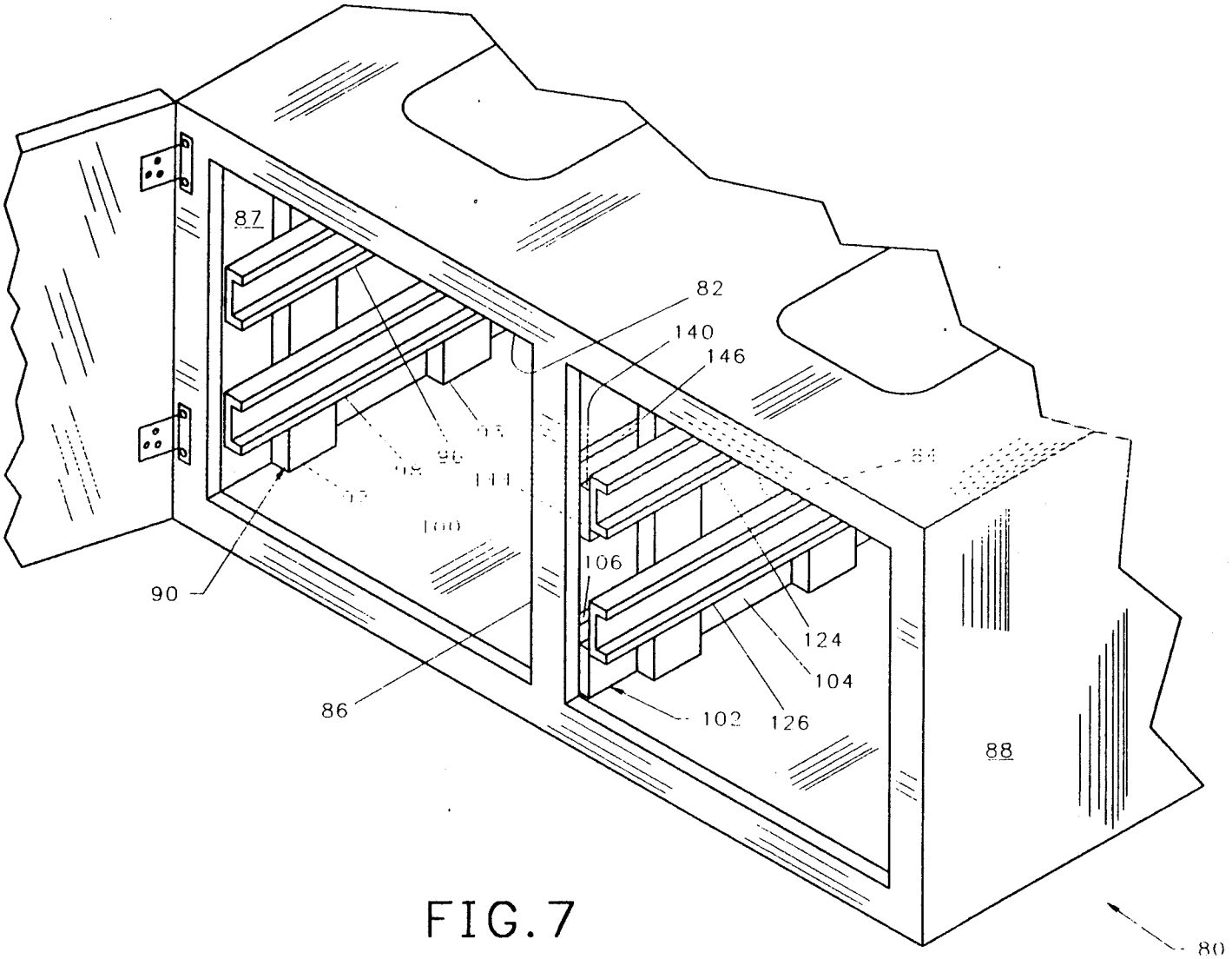
FIG. 7 is a fragmentary isometric view of a bathroom vanity type cabinet having two sinks in which adjustable width channel assemblies and one guide mount assembly have been installed behind the center partition.
Figure 8:
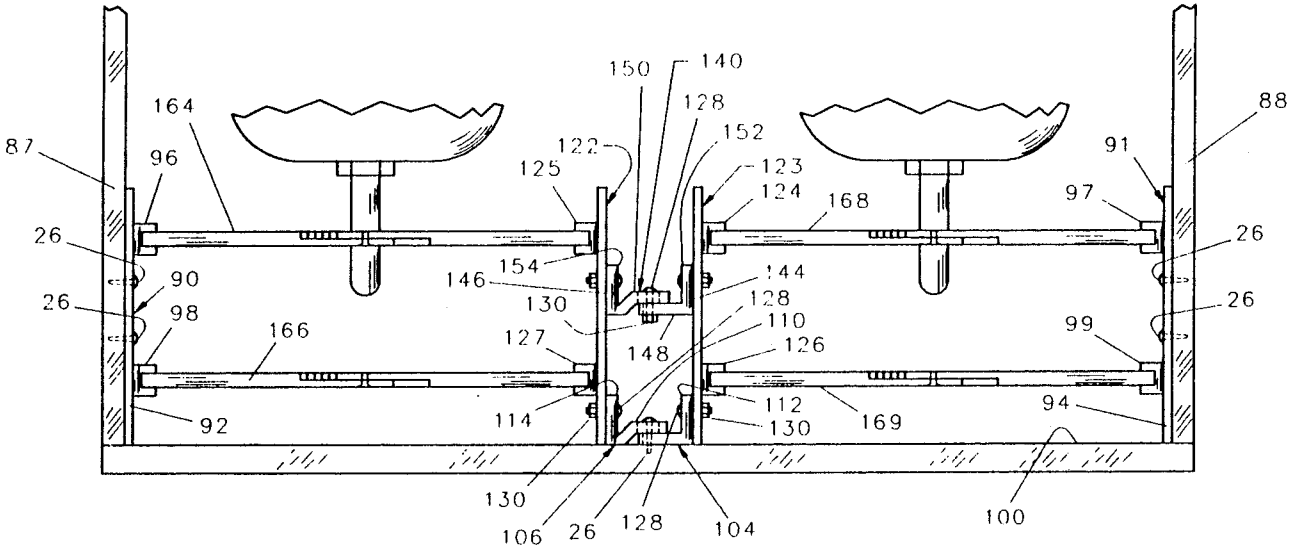
FIG. 8 is a fragmentary cross-sectional view taken across the front of the shelving systems shown in FIG. 7.
Figure 10:
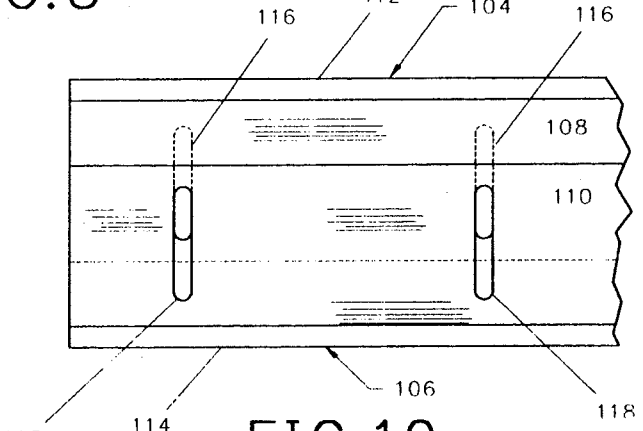
FIG. 10 is an enlarged fragmentary top view of the channel assembly as shown in FIG. 7.
Figure 9:
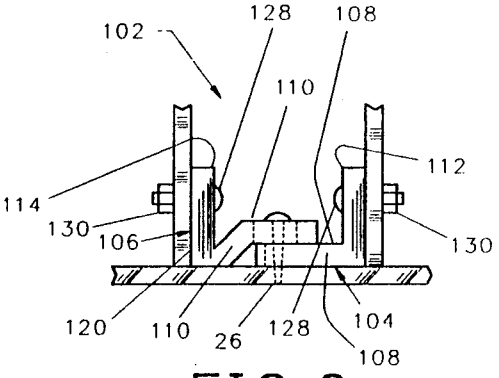
FIG. 9 is an enlarged end view of a channel assembly as shown in FIG. 7.

The shelf parts 38*a* and 38*b* are provided with arcuate portions 60 and 61 at the location of the cutout 40, and the rear end of the filler piece 58 is provided with a similar arcuate edge 64. In order to facilitate adjustment of the width of the filler piece 58, a plurality of kerfs 66 are cut in the bottom thereof as best shown in FIG. 5. The filler piece 58 can thus be easily cut or broken along one of the kerfs to provide the desired width to fill the space at the top of the shelf. The bottom shelf is constructed similar to the top shelf except for the omission of the cutout 40.

Referring to FIG. 7 to 10, a cabinet is depicted having an enclosure 80 provided with two separate openings 82, 84. In this case the cabinet 80 is shown as providing two plumbing fixtures. The two openings 82, 84 are separated by a vertical frontal partition 86, and each of the openings 82,84 is provided with shelves in accordance with the present invention.

The outer walls 87, 88 of the enclosure 80 are provided with a shelf guide mount assemblies 90, 91 similar to that previously described. The shelf guide mount assemblies 90, 91 each include a pair of spaced vertically disposed support members 92, 93, 94, 95 respectively. Attached to the support members 92, 93, 94, 95 are horizontally disposed parallel guide rails 96, 97, 98, 99 which are C-channels having upper and lower inwardly extending flanges.

Along the floor 100, behind the center partition 86, there is provided an adjustable width channel assembly 102 disposed parallel to the two outer walls 87, 88. The channel assembly 102 includes a first angle iron 104 and a second angle iron 106, each of which have horizontally disposed web sections 108 and 110 respectively and vertically disposed web sections 112 and 114 respectively. The vertical web sections 112, 114 of each of the angle irons 104, 106 are positioned parallel to each other on opposite sides of the transverse center of the floor 100, adjacent openings 82 and 84, and parallel to the outer walls 87, 88. The horizontal web section 110 of the second angle iron 106 is positioned over the horizontal web section 108 of the first angle iron 104. The horizontal web sections 108, 110 are each provided with a plurality of transverse slot 116 and 118 respectively, with the positions of the slots 116 along the length of the first horizontal web section 108 corresponding to the positions of the slots 118 along the length of the second horizontal web section 110. When the two horizontal web sections 108, 110 are positioned across the center of the floor 100 the slots 118 of the second horizontal web section 110 will be positioned over the slots 116 of the first horizontal web section 108 and both are held in place by a plurality of fasteners 26. In the preferred embodiment the second angle iron 106 has an offset 120 at the joinder of the horizontal web section 110 and the vertical web section 114 such that the vertical web section 114 will be supported when the horizontal web section 110 is positioned over the horizontal web section 108 of the first angle iron 104.

Guide mount assemblies 122 and 123 having upper guide rails 124, 125 respectively and lower guide rails 126, 127 respectively as previously described for assembly 24, are secured to the outer surfaces of the vertical web sections 112, 114 in back to back relationship to each other by a plurality of bolts 128 which pass through holes, not shown, in both the vertical web sections 112, 114 and the guide mount assemblies 122, 123 and into associated nuts 130.

The upper portions of the guide mount assemblies 122, 123 are held in parallel relationship to each other by an upper adjustable width channel assembly 140. Like the lower channel assembly 102, the upper assembly consists of first and second angle irons 144 and 146 each having a horizontally disposed web section 148, 150 and a vertically disposed web section 152, 154 respectively. The horizontally disposed web sections 148, 150 each have a plurality of transverse slots, not shown, which are positioned so as to be aligned with each other when horizontal web section 150 is positioned over lower web section 148. A plurality of bolts 128 are passed through the aligned slots and are tightened into a plurality of associated nuts 130 to hold the angle irons 144, 146 in the desired relationship. A plurality of bolts 128, which pass through holes in the guide mount assemblies 122, 123, through corresponding holes the vertical web sections 152, 154 and into associated nuts 130 also hold the guide mount assemblies 122, 123 to the upper adjustable width channel assembly 140.

Upper and lower shelves 164, 166 are fitted within guide rails 96, 125 and 98, 127 respectively and are positioned to slide through the opening 82 on the left side of partition 86. Similarly, upper and lower shelves 168, 169 are fitted within corresponding guide rails, including guide rails 97, 124 and 99, 126, and are positioned to slide through opening 84 on the right side of partition 86. Each of the shelves 164, 166, 168, 169 has first and second shelf members with overlapping centrally disposed central sections and filler pieces similar to upper shelf 38 as described with the first embodiment. In cabinets with plumbing, the upper shelf must be provided with a cut out 40 as described for upper shelf 38, but neither the upper nor the lower shelves require such cut outs when the system is installed in a cabinet without plumbing.

INSTALLATION

For a single opening in a cabinet, the system of the present invention may thus be seen to include two identical rail assemblies 24, eight fasteners 26, and two shelf assemblies 36, or one lower shelf assembly 36 and one upper shelf assembly 38 if the cabinet includes a sink having depending plumbing. The rail assemblies 24 are first positioned against the left and right side walls 12 of the cabinet as shown in FIG. 1, 2, and 3 and attached thereto by the fasteners 26. Then the lengths of the shelves are adjusted so that the ends thereof rest on the lower flanges of the associated rails without binding against the webs of the rails. The nut and bolt assemblies 54 and 56 are then tightened to prevent spurious relative movement between the shelf parts. One of the filler pieces 58 is then placed over the space at the end of tongue 49 and appropriately marked. The filler piece is then cut or broken along the next closest kerf and placed in the space above the tongue 47 at the end of the tongue 49. It is not necessary to fasten the filler piece in place. The adjusted shelf is then slid into the appropriate pair of rails. In like manner the other shelf is adjusted to the proper length and slid into the other pair of rails. Because the shelves are located in a relatively low position making it difficult to reach to the back portions thereof, it is most convenient that the shelves are horizontally slidable for ease of access to whatever articles may be placed thereon. The provisions of the cutout in the upper shelf of bathroom type vanities enables the use of an upper shelf which greatly increases the usable storage space in such cabinets. Of course, the upper shelf can be easily removed when access to the plumbing is desired.

When the system is installed in a cabinet having a center partition 86, the system is installed behind the openings on each side of the partition. In this case, four rail assemblies 24, ten fasteners 26, two suitable upper shelves assemblies 36 or 38, two lower shelf assemblies 36, and two adjustable width channel assemblies 102, and 140, and ten nut and bolt assemblies 128, 130 are used. One rail assembly is attached to each of the outer walls of the cabinet and held in position by eight of the fasteners as described above. Next the lower adjustable width channel assembly 102 is positioned o the floor 100 parallel to the outer walls and behind the partition 86. The width of the channel assembly should be adjusted so that when the guide mount assemblies are attached to the lower channel assembly the guide rails will accept shelves having widths which fit within the widths of the openings 82, 84. The lower adjustable width channel assembly 102 is held in place by the remaining two fasteners 26. Next a guide mount assembly is bolted to each of the two vertical web sections 112, 114 of the lower adjustable width channel assembly 102 and tightened with associated nuts. The vertical web portions of the upper adjustable width channel assembly 140 are then attached by bolts and nuts to the upper portion of the guide mount assemblies and the angle irons are held in position relative to each other by the remaining nuts and bolts. Finally, shelves are assembled as previously described, two shelf for each of the openings 82, 84.

While the present invention has been described in connection with two embodiments, it will be understood by those skilled in the art that many changes may be made without departing from the true spirit and scope of the present invention. Therefore, it is intended by the appended claims to cover all such changes and modifications which come within the true spirit and scope of this invention.

What is claimed:

1. A shelving system for mounting in a cabinet having first and second upstanding side walls, comprising in combination, first and second rail mount assemblies adapted to be mounted on respective side walls of said cabinet, said assemblies each having at least one vertical support member adapted to be mounted to one of said walls, and a horizontal rail channel having outer flanges spaced a fixed distance from each other, said rail channel being affixed to said support member, a shelf assembly including first and second longitudinally adjustable shelf members, each of said shelf members having an inner end portion, a distal end portion, and a thickness less than said distance between said flanges of said rail channel, each of said distal end portions being received within said rail channels, each of said inner portions having a longitudinally extending tongue having a thickness less than said thickness of said shelf member, said tongues of said first and second shelf members overlapping each other, and means for locking said shelf members together in a longitudinally adjusted position.

2. The combination according to claim 1 wherein said shelf members have rearwardly disposed cut out portions at said inner ends for receiving plumbing connections disposed in the upper portion of said cabinet.

3. The combination according to claim 1 wherein said vertical support member is a metallic channel, and said rail channel is welded thereto.

4. The combination according to claim 1 wherein said first and second assemblies each include a second horizontal rail channel affixed to said vertical support members.

5. The combination according to claim 1 wherein said first and second shelf members have respective upper surfaces which are in the same plane with one another.

6. The combination according to claim 5 and further comprising:

a filler piece disposed on top of one of said tongues adjacent to the distal end of the other of said tongues, and said filler piece having a flat upper surface lying flush with the upper surfaces of said first an second shelf members.

7. The combination in accordance with claim 6 wherein said shelf members have rearwardly disposed cut out portions at said inner ends for receiving plumbing connections disposed in the upper portions of a cabinet.

8. The combination according to claim 7 wherein said filler piece is provided with a plurality of mutually parallel lines of weakness extending perpendicularly to the principal longitudinal axes of said shelf members.

9. The combination according to claim 8 wherein said filler piece is made of wood, and said lines of weakness are provided by kerfs in the bottom side of said filler piece.

10. The combination according to claim 9 wherein said mounting means comprises a vertical web section and a horizontal web section.

11. A shelving system for mounting in a cabinet having first and second upstanding sidewalls, a floor, and a frontal partition between said side walls, said shelving system comprising in combination:

an adjustable width assembly having first and second adjustable members for mounting opposing vertical members thereon in back-to-back relationship one on each side of said frontal partition and parallel to said walls of said cabinet, said first and second adjustable members adapted to adjust the distance between vertical members mounted thereon and to hold vertical members mounted thereon a fixed distance from each other, first and second rail mount assemblies mounted on each of said adjustable members, one on each side of said frontal partition in back-to-back relationship, said rail mount assemblies each having at least one vertical support member and a horizontal rail channel affixed to said support member, at least one rail channel mounted to each of said side walls, each of said wall mounted rail channels opposing one of said rail channels on said rail mount assemblies, and a longitudinally adjustable shelf member slidably disposed between each set of said opposing rail channels.

12. The combination according to claim 11 further comprising: second adjustable width assembly mounted above the first of said assemblies, and between said first and second rail mount assemblies.

13. The combination according to claim 12 further comprising: third and fourth rail mount assemblies mounted on said side walls for supporting said rail channels on each of said side walls.

* * * * *